US011205411B2

(12) United States Patent
Hou

(10) Patent No.: US 11,205,411 B2
(45) Date of Patent: Dec. 21, 2021

(54) AUDIO SIGNAL PROCESSING METHOD AND DEVICE, TERMINAL AND STORAGE MEDIUM

(71) Applicant: BEIJING XIAOMI INTELLIGENT TECHNOLOGY CO., LTD., Beijing (CN)

(72) Inventor: Haining Hou, Beijing (CN)

(73) Assignee: Beijing Xiaomi Intelligent Technology Co., Ltd., Beijing (CN)

( * ) Notice: Subject to any disclaimer, the term of this patent is extended or adjusted under 35 U.S.C. 154(b) by 0 days.

(21) Appl. No.: 16/888,388

(22) Filed: May 29, 2020

(65) Prior Publication Data

US 2021/0183351 A1 Jun. 17, 2021

(30) Foreign Application Priority Data

Dec. 17, 2019 (CN) ..... 201911302374.8

(51) Int. Cl.
*G10K 11/175* (2006.01)
*H04R 1/22* (2006.01)
(Continued)

(52) U.S. Cl.
CPC ..... *G10K 11/1752* (2020.05); *H04R 1/222* (2013.01)

(58) Field of Classification Search
CPC . H04R 1/222; H04R 1/22; H04R 1/24; H04R 1/245; H04R 1/265; H04R 1/20; H04R 2499/11; H04R 2499/13; H04R 1/406; H04R 1/1083; H04R 1/10; H04R 1/40; H04R 2410/05; H04R 3/005;
(Continued)

(56) References Cited

U.S. PATENT DOCUMENTS 9,654,894 B2 * 5/2017 Nesta ..... G10L 21/0208
2010/0082340 A1 * 4/2010 Nakadai ..... G10L 21/0272 704/233
(Continued)

OTHER PUBLICATIONS

Toru et al "An Improvement in Automatic Speech Recognition Using Soft Missing Feature Masks for Robot Audition", The 2010 IEEE/RSJ International Conference on Intelligent Robots and Systems, p. 964-969, Oct. 18-22, 2010.*

Pedersen, Michael Syskind et al., "Separating Underdetermined Convolutive Speech Mixtures", Independent Component Analysis and Blind Signal Separation Lecture Notes in Computer Science; ; LNCS, Springer, Berlin, DE, (8p), Jan. 1, 2006.*
(Continued)

*Primary Examiner* — Leshui Zhang
(74) *Attorney, Agent, or Firm* — Arch & Lake LLP

(57) ABSTRACT

A method for processing audio signal includes that: audio signals emitted respectively from at least two sound sources are acquired through at least two microphones to obtain respective original noisy signals of the at least two microphones; sound source separation is performed on the respective original noisy signals of the at least two microphones to obtain respective time-frequency estimated signals of the at least two sound sources; a mask value of the time-frequency estimated signal of each sound source in the original noisy signal of each microphone is determined based on the respective time-frequency estimated signals; the respective time-frequency estimated signals of the at least two sound sources are updated based on the respective original noisy signals of the at least two microphones and the mask values; and the audio signals emitted respectively from the at least two sound sources are determined.

17 Claims, 5 Drawing Sheets

(51) Int. Cl.

| | |
|---|---|
| ***H04R 1/40*** | (2006.01) |
| ***H04R 1/10*** | (2006.01) |
| ***G10L 21/0232*** | (2013.01) |
| ***G10L 21/0272*** | (2013.01) |
| ***G10L 21/0224*** | (2013.01) |
| ***H04R 3/00*** | (2006.01) |

(58) Field of Classification Search

CPC .. H04R 3/00; G10K 11/1752; G10K 11/1754; G10K 11/175; G10K 11/16; G10L 21/0232; G10L 21/0272; G10L 21/0224; G10L 2021/02166; G10L 2021/02161

USPC ..... 381/73.1, 94.2, 94.3, 17, 18; 704/200, 704/226, 227, 228, 233, 234, 236, 237, 704/240, 250, 255, 257; 700/94

See application file for complete search history.

(56) References Cited

U.S. PATENT DOCUMENTS

2015/0117649 A1* 4/2015 Nesta ..... H04S 7/305 381/17

2017/0251301 A1 8/2017 Nesta et al.

OTHER PUBLICATIONS

Extended European Search Report in the European Application No. 20179695.0, dated Nov. 27, 2020 (9p).

Pedersen, Michael Syskind et al., "Separating Underdetermined Convolutive Speech Mixtures" Jan. 1, 2006, Independent Component Analysis and Blind Signal Separation Lecture Notes in Computer Science; ; LNCS, Springer, Berlin, DE, (8p).

* cited by examiner

AUDIO SIGNAL PROCESSING METHOD AND DEVICE, TERMINAL AND STORAGE MEDIUM

CROSS-REFERENCE TO RELATED APPLICATION

This application is based upon and claims priority to Chinese Patent Application No. CN201911302374.8, filed on Dec. 17, 2019, the entire contents of which are incorporated herein by reference for all purposes.

TECHNICAL FIELD

The present disclosure generally relates to the technical field of communication, and more particularly, to a method and device for processing audio signal, a terminal and a storage medium.

BACKGROUND

In a related art, an intelligent product device mostly adopts a Microphone (MIC) array for sound-pickup, and a MIC beamforming technology is adopted to improve quality of voice signal processing to increase a voice recognition rate in a real environment. However, a multi-MIC beamforming technology is sensitive to a MIC position error, resulting in relatively great influence on performance. In addition, increase of the number of MICs may also increase product cost.

Therefore, more and more intelligent product devices are configured with only two MICs at present. For the two MICs, a blind source separation technology that is completely different from the multi-MIC beamforming technology is usually adopted for voice enhancement. How to improve quality of a voice signal separated based on the blind source separation technology is a problem urgent to be solved at present.

SUMMARY

The present disclosure provides a method and device for processing audio signal and a storage medium.

According to a first aspect of the disclosure, a method for processing audio signal is provided, and the method includes: acquiring, by at least two microphones of a terminal, a plurality of audio signals emitted respectively from at least two sound sources, to obtain respective original noisy signals of the at least two microphones; performing, by the terminal, sound source separation on the respective original noisy signals of the at least two microphones to obtain respective time-frequency estimated signals of the at least two sound sources; determining, by the terminal, a mask value of the time-frequency estimated signal of each sound source in the original noisy signal of each microphone based on the respective time-frequency estimated signals of the at least two sound sources; updating, by the terminal, the respective time-frequency estimated signals of the at least two sound sources based on the respective original noisy signals of the at least two microphones and the mask values; and determining, by the terminal, the plurality of audio signals emitted from the at least two sound sources respectively based on the respective updated time-frequency estimated signals of the at least two sound sources.

According to a second aspect of the present disclosure, a device for processing audio signal is provided. The device includes a processor and a memory for storing a set of instructions executable by the processor. The processor is configured to execute the instructions to: acquire a plurality of audio signals emitted respectively from at least two sound sources through at least two MICs to obtain respective original noisy signals of the at least two microphones; perform sound source separation on the respective original noisy signals of the at least two microphones to obtain respective time-frequency estimated signals of the at least two sound sources; determine a mask value of the time-frequency estimated signal of each sound source in the original noisy signal of each microphone based on the respective time-frequency estimated signals of the at least two sound sources; update the respective time-frequency estimated signals of the at least two sound sources based on the respective original noisy signals of the at least two microphones and the mask values; and determine the plurality of audio signals emitted respectively from the at least two sound sources based on the respective updated time-frequency estimated signals of the at least two sound sources.

According to a third aspect of the present disclosure, there is provided a non-transitory computer-readable storage medium storing a plurality of programs for execution by a terminal having one or more processors, wherein the plurality of programs, when executed by the one or more processors, cause the terminal to perform acts including: acquiring a plurality of audio signals emitted respectively from at least two sound sources through at least two microphones, to obtain respective original noisy signals of the at least two microphones; performing sound source separation on the respective original noisy signals of the at least two microphones to obtain respective time-frequency estimated signals of the at least two sound sources; determining a mask value of the time-frequency estimated signal of each sound source in the original noisy signal of each microphone based on the respective time-frequency estimated signals of the at least two sound sources; updating the respective time-frequency estimated signals of the at least two sound sources based on the respective original noisy signals of the at least two microphones and the mask values; and determining the plurality of audio signals emitted respectively from the at least two sound sources based on the respective updated time-frequency estimated signals of the at least two sound sources.

It is to be understood that the above general descriptions and detailed descriptions below are only exemplary and explanatory and not intended to limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of devices and methods consistent with aspects related to the present disclosure as recited in the appended claims.

Figure 1:
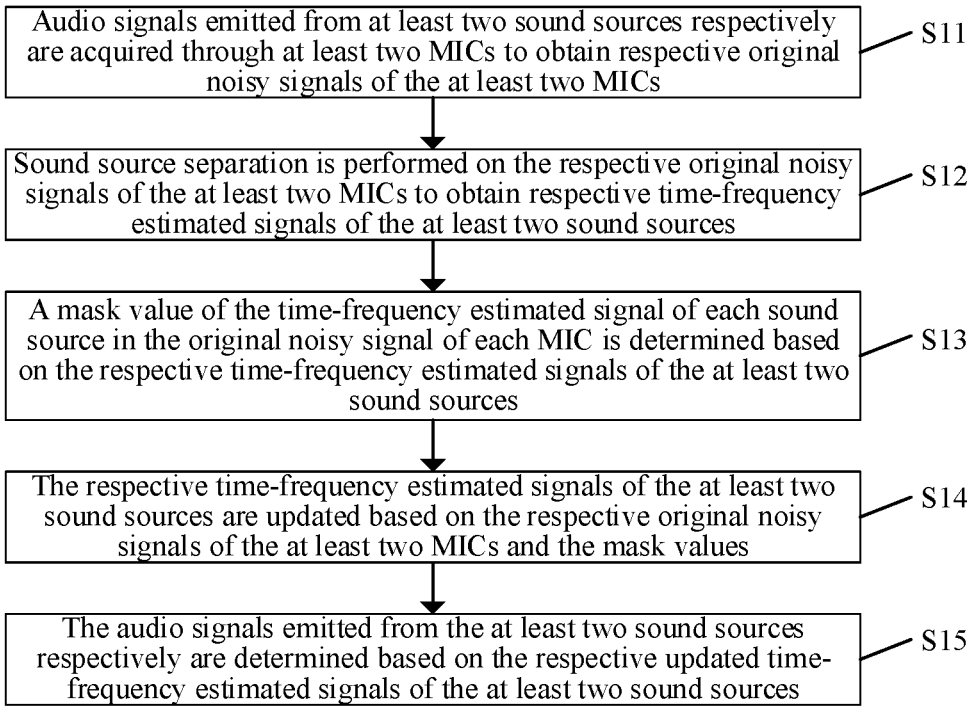
FIG. 1 is a flow chart showing a method for processing audio signal, according to some embodiments of the disclosure.

FIG. 1 is a flow chart showing a method for processing audio signal, according to some embodiments of the disclosure. As shown in FIG. 1, the method includes the following operations.

At block S11, audio signals emitted from at least two sound sources respectively are acquired through at least two MICs to obtain respective original noisy signals of the at least two MICs.

At block S12, sound source separation is performed on the respective original noisy signals of the at least two MICs to obtain respective time-frequency estimated signals of the at least two sound sources.

At block S13, a mask value of the time-frequency estimated signal of each sound source in the original noisy signal of each MIC is determined based on the respective time-frequency estimated signals of the at least two sound sources.

At block S14, the respective time-frequency estimated signals of the at least two sound sources are updated based on the respective original noisy signals of the at least two MICs and the mask values.

At block S15, the audio signals emitted from the at least two sound sources respectively are determined based on the respective updated time-frequency estimated signals of the at least two sound sources.

The method of the embodiment of the present disclosure is applied to a terminal. Herein, the terminal is an electronic device integrated with two or more than two MICs. For example, the terminal may be a vehicle terminal, a computer or a server. In an embodiment, the terminal may be an electronic device connected with a predetermined device integrated with two or more than two MICs, and the electronic device receives an audio signal acquired by the predetermined device based on this connection and sends the processed audio signal to the predetermined device based on the connection. For example, the predetermined device is a speaker.

During a practical application, the terminal includes at least two MICs, and the at least two MICs simultaneously detect the audio signals emitted from the at least two sound sources respectively to obtain the respective original noisy signals of the at least two MICs. Herein, it can be understood that, in the embodiment, the at least two MICs synchronously detect the audio signals emitted from the two sound sources.

The method for processing audio signal according to the embodiment of the present disclosure may be implemented in an online mode and may also be implemented in an offline mode. Implementation in the online mode refers to that acquisition of an original noisy signal of an audio frame and separation of an audio signal of the audio frame may be simultaneously implemented. Implementation in the offline mode refers to that audio signals of audio frames in a predetermined time are started to be separated after original noisy signals of the audio frames in the predetermined time are completely acquired.

In the embodiment of the present disclosure, there are two or more than two MICs, and there are two or more than two sound sources.

In the embodiment of the present disclosure, the original noisy signal is a mixed signal including sounds emitted from the at least two sound sources. For example, there are two MICs, i.e., a first MIC and a second MIC respectively; and there are two sound sources, i.e., a first sound source and a second sound source respectively. In such case, the original noisy signal of the first MIC includes the audio signals from the first sound source and the second sound source, and the original noisy signal of the second MIC also includes the audio signals from both the first sound source and the second sound source.

For example, there are three MICs, i.e., a first MIC, a second MIC and a third MIC respectively, and there are three sound sources, i.e., a first sound source, a second sound source and a third sound source respectively. In such case, the original noisy signal of the first MIC includes the audio signals from the first sound source, the second sound source and the third sound source, and the original noisy signals of the second MIC and the third MIC also include the audio signals from the first sound source, the second sound source and the third sound source, respectively.

Herein, the audio signal may be a value obtained after inverse Fourier transform is performed on the updated time-frequency estimated signal.

Herein, if the time-frequency estimated signal is a signal obtained by a first separation, the updated time-frequency estimated signal is a signal obtained by a second separation.

Herein, the mask value refers to a proportion of the time-frequency estimated signal of each sound source in the original noisy signal of each MIC.

It can be understood that, if a signal from a sound source is an audio signal in a MIC, a signal from another sound source is a noise signal in the MIC. According to the embodiment of the present disclosure, the sounds emitted from the at least two sound sources are required to be recovered through the at least two MICs.

In the embodiment of the present disclosure, the original noisy signals of the at least two MICs are separated to obtain the time-frequency estimated signals of sounds emitted from the at least two sound sources in each MIC, so that preliminary separation may be implemented by use of dependence between signals of different sound sources to separate the sounds emitted from the at least two sound sources in the original noisy signals. Therefore, compared with the solution in which signals from the sound sources are separated by use of a multi-MIC beamforming technology in the related art, this manner has the advantage that positions of these MICs are not required to be considered, so that the audio signals of the sounds emitted from the sound sources may be separated more accurately.

In addition, in the embodiments of the present disclosure, the mask values of the at least two sound sources with respect to the respective MIC may also be obtained based on the time-frequency estimated signals, and the updated time-frequency estimated signals of the sounds emitted from the at least two sound sources are acquired based on the original noisy signals of each MIC and the mask values. Therefore, in the embodiments of the present disclosure, the sounds emitted from the at least two sound sources may further be separated according to the original noisy signals and the preliminarily separated time-frequency estimated signals. Moreover, the mask value is a proportion of the time-frequency estimated signal of each sound source in the original noisy signal of each MIC, so that part of bands that are not separated by preliminary separation may be recovered into the audio signals of the respective sound sources, voice damage degrees of the separated audio signals may be reduced, and the separated audio signal of each sound source is higher in quality.

In addition, if the method for processing audio signal is applied to a terminal device with two MICs, compared with the conventional art that voice quality is improved by use of a beamforming technology based on at least more than three MICs, the method also has the advantages that the number of the MICs is greatly reduced, and hardware cost of the terminal is reduced.

It can be understood that, in the embodiment of the present disclosure, the number of the MICs is usually the same as the number of the sound sources. In some embodiments, if the number of the MICs is smaller than the number of the sound sources, a dimensionality of the number of the sound sources may be reduced to a dimensionality equal to the number of the MICs.

In some embodiments, the operation that the sound source separation is performed on the respective original noisy signals of the at least two MICs to obtain the respective time-frequency estimated signals of the at least two sound sources includes the following actions.

A first separated signal of a present frame is acquired based on a separation matrix and the original noisy signal of the present frame. The separation matrix is a separation matrix for the present frame or a separation matrix for a previous frame of the present frame.

The time-frequency estimated signal of each sound source is obtained by a combination of the first separated signal of each frame.

It can be understood that, when the MIC acquires the audio signal of the sound emitted from the sound source, at least one audio frame of the audio signal may be acquired and the acquired audio signal is the original noisy signal of each MIC.

The operation that the original noisy signal of each frame of each MIC is acquired includes the following actions.

A time-domain signal of each frame of each MIC is acquired.

Frequency-domain transform is performed on the time-domain signal of each frame, and the original noisy signal of each frame is determined according to a frequency-domain signal at a predetermined frequency point.

Herein, frequency-domain transform may be performed on the time-domain signal based on Fast Fourier Transform (FFT). In an example, frequency-domain transform may be performed on the time-domain signal based on Short-Time Fourier Transform (STFT). In an example, frequency-domain transform may also be performed on the time-domain signal based on other Fourier transform.

In an example, if a time-domain signal of an nth frame of the p th MIC is $x_p''(m)$, the time-domain signal of then th frame of is converted into a frequency-domain signal, and the original noisy signal of the n th frame is determined to be: $X_p(k,n)=STFT(x_p''(m))$, where m is the number of discrete time points of time-domain signal of the n th frame, and k is the frequency point. Therefore, according to the embodiment, the original noisy signal of each frame may be obtained by conversion from a time domain to a frequency domain. Of course, the original noisy signal of each frame may also be acquired based on another FFT formula. There are no limits made herein.

In the embodiment of the present disclosure, the original noisy signal of each frame may be obtained, and then the first separated signal of the present frame is obtained based on the separation matrix and the original noisy signal of the present frame. Herein, the operation that the first separated signal of the present frame is acquired based on the separation matrix and the original noisy signal of the present frame may be implemented as follows: the first separated signal of the present frame is obtained based on a product of the separation matrix and the original noisy signal of the present frame. For example, if the separation matrix is W(k) and the original noisy signal of the present frame is X(k,n), the first separated signal of the present frame is Y(k,n)=W(k)X(k,n).

In an embodiment, if the separation matrix is the separation matrix for the present frame, the first separated signal of the present frame is obtained based on the separation matrix for the present frame and the original noisy signal of the present frame.

In another embodiment, if the separation matrix is the separation matrix for the previous frame of the present frame, the first separated signal of the present frame is obtained based on the separation matrix for the previous frame and the original noisy signal of the present frame.

In an embodiment, if a frame length of the audio signal acquired by the MIC is n, n being a natural number more than or equal to 1, in case of n=1, the previous frame is a first frame.

In some embodiments, when the present frame is a first frame, the separation matrix for the first frame is an identity matrix.

The operation that the first separated signal of the present frame is acquired based on the separation matrix and the original noisy signal of the present frame includes the following action.

The first separated signal of the first frame is acquired based on the identity matrix and the original noisy signal of the first frame.

Herein, if the number of the MICs is two, the identity matrix is $$W(k)=\begin{bmatrix}1 & 0\\ 0 & 1\end{bmatrix};$$

if the number of the MICs is three, the identity matrix is $$W(k)=\begin{bmatrix}1 & 0 & 0\\ 0 & 1 & 0\\ 0 & 0 & 1\end{bmatrix};$$

and by parity of reasoning, if the number of the MICs is N, the identity matrix may be $$W(k)=\begin{bmatrix}1 & 0 & L & 0\\ 0 & 1 & L & 0\\ L & L & L & L\\ 0 & 0 & L & 1\end{bmatrix}.\ W(k)=\begin{bmatrix}1 & 0 & L & 0\\ 0 & 1 & L & 0\\ L & L & L & L\\ 0 & 0 & L & 1\end{bmatrix}$$

is an N×N matrix.

In some other embodiments, if the present frame is an audio frame after the first frame, the separation matrix for the present frame is determined based on the separation matrix for the previous frame of the present frame and the original noisy signal of the present frame.

In an embodiment, an audio frame may be an audio band with a preset time length.

In an example, the operation that the separation matrix for the present frame is determined based on the separation matrix for the previous frame of the present frame and the original noisy signal of the present frame may specifically be implemented as follows. A covariance matrix of the present frame may be calculated at first according to the original noisy signal and a covariance matrix of the previous frame. Then the separation matrix for the present frame is calculated based on the covariance matrix of the present frame and the separation matrix for the previous frame.

If it is determined that the n th frame is the present frame and the n−1th frame is the previous frame of the present frame, the covariance matrix of the present frame may be calculated at first according to the original noisy signal and the covariance matrix of the previous frame. The covariance matrix is $V_p(k,n)=\beta V_p(k, n-1)+(1-\beta)\varphi_p(k,n)\ X_p(k,n)\ X_p^H(k,n)$, where $\beta$ is a smoothing coefficient, $V_p(k,n-1)$ is an updated covariance of the previous frame, $\varphi_p(k,n)$ is a weighting coefficient, $X_p(k,n)$ is the original noisy signal of the present frame, and $X_p^H(k,n)$ is a conjugate transpose matrix of the original noisy signal of the present frame. Herein, the covariance matrix of the first frame is a zero matrix. In an embodiment, after the covariance matrix of the present frame is obtained, the following eigenproblem may further be solved: $V_2(k,n)\ e_p(k,n)=\lambda_p(k,n)\ V,(k,n)\ e_p(k,n)$, and the separation matrix of the present frame is calculated to be $$w_p(k) = \frac{e_p(k, n)}{e_p^H(k, n)V_P(k, n)e_p(k, n)},$$

where $\lambda_p(k,n)$ is an eigenvalue, and $e_p(k,n)$ is an eigenvector.

In the embodiment, in the case that the first separated signal is obtained according to the separation matrix of the present frame and the original noisy signal of the present frame, since the separation matrix is an updated separation matrix of the present frame, a proportion of the sound emitted from each sound source in the corresponding MIC may be dynamically tracked, so the obtained first separated signal is more accurate, which may facilitate obtaining a more accurate time-frequency estimated signal. In the case that the first separated signal is obtained according to the separation matrix of the previous frame of the present frame and the original noisy signal of the present frame, the calculation for obtaining the first separated signal is simpler, so that a calculation process for calculating the time-frequency estimated signal is simplified.

In some embodiments, the operation that the mask value of the time-frequency estimated signal of each sound source in the original noisy signal of each MIC is determined based on the respective time-frequency estimated signals of the at least two sound sources includes the following action.

The mask value of a sound source with respect to a MIC is determined to be a proportion of the time-frequency estimated signal of the sound source in the MIC and the original noisy signal of the MIC.

For example, there are three MICs, i.e., a first MIC, a second MIC and a third MIC respectively, and there are three sound sources, i.e., a first sound source, a second sound source and a third sound source respectively. The original noisy signal of the first MIC is X1 and the time-frequency estimated signals of the first sound source, the second sound source and the third sound source are Y1, Y2 and Y3 respectively. In such case, the mask value of the first sound source with respect to the first MIC is Y1/X1, the mask value of the second sound source with respect to the first MIC is Y2/X1, and the mask value of the third sound source with respect to the first MIC is Y3/X1.

Based on the example, the mask value may also be a value obtained after the proportion is transformed through a logarithmic function. For example, the mask value of the first sound source with respect to the first MIC is $\alpha\times\log(Y_1/X_1)$, the mask value of the second sound source with respect to the first MIC is $\alpha\times\log(Y_2/X_1)$, and the mask value of the third sound source with respect to the first MIC is $\alpha\times\log(Y_3/X_1)$, where a is an integer. In an embodiment, $\alpha$ is 20. In the embodiment, transforming the proportion through the logarithmic function may synchronously reduce a dynamic range of each mask value to ensure that the separated voice is higher in quality.

In an embodiment, a base number of the logarithmic function is 10 or e. For example, in the embodiment, $\log(Y_1/X_1)$ may be $\log_{10}(Y_1/X_1)$ or $\log_e(Y_1/X_1)$.

In another embodiment, if there are two MICs and two sound sources, the operation that the mask value of the time-frequency estimated signal of each sound source in the original noisy signal of each MIC is determined based on the respective time-frequency estimated signals of the at least two sound sources includes the following action.

A ratio of the time-frequency estimated signal of a sound source and the time-frequency estimated signal of another sound source in the same MIC is determined.

For example, there are two MICs, i.e., a first MIC and a second MIC respectively, and there are two sound sources, i.e., a first sound source and a second sound source respectively. The original noisy signal of the first MIC is $X_1$, and the original noisy signal of the second MIC is $X_2$. The time-frequency estimated signal of the first sound source in the first MIC is $Y_{11}$, and the time-frequency estimated signal of the second sound source in the second MIC is $Y_{22}$. In such case, the time-frequency estimated signal of the second sound source in the first MIC is obtained to be $Y_{12}=X_1-Y_{11}$ by calculations, and the time-frequency estimated signal of the first sound source in the second MIC is obtained to be $Y_{21}=X_2-Y_{22}$ by calculations. Furthermore, the mask value of the first sound source in the first MIC is obtained based on $Y_{11}/Y_{12}$, and the mask value of the first sound source in the second MIC is obtained based on $Y_{21}/Y_{22}$.

In some other embodiments, the operation that the mask value of the time-frequency estimated signal of each sound source in the original noisy signal of each MIC is determined based on the respective time-frequency estimated signals of the at least two sound sources includes the following actions.

A proportion value is obtained based on the time-frequency estimated signal of a sound source in each MIC and the original noisy signal of the MIC.

Nonlinear mapping is performed on the proportion value to obtain the mask value of the sound source in each MIC.

The operation that nonlinear mapping is performed on the proportion value to obtain the mask value of the sound source in each MIC includes the following action.

Nonlinear mapping is performed on the proportion value by use of a monotonic increasing function to obtain the mask value of the sound source in each MIC.

For example, nonlinear mapping is performed on the proportion value according to a sigmoid function to obtain the mask value of the sound source in each MIC.

Herein, the sigmoid function is a nonlinear activation function. The sigmoid function is used to map an input function to an interval (0, 1). In an embodiment, the sigmoid function is $$sigmoid(x) = \frac{1}{1 + e^{-x}},$$

where x is the mask value. In another embodiment, the sigmoid function is $$sigmoid(x, a, c) = \frac{1}{1 + e^{-a(x-c)}},$$

where x is the mask value, a is a coefficient representing a degree of curvature of a function curve of the sigmoid function, and c is a coefficient representing translation of the function curve of the sigmoid function on the axis x.

In another embodiment, the monotonic increasing function may be $$sigmoid(x, a_1) = \frac{1}{1 + a_1^{-x}},$$

where x is the mask value and $a_1$ is greater than 1.

In an example, there are two MICs, i.e., a first MIC and a second MIC respectively, and there are two sound sources, i.e., a first sound source and a second sound source respectively. The original noisy signal of the first MIC is $X_1$, and the original noisy signal of the second MIC is $X_2$. The time-frequency estimated signal of the first sound source in the first MIC is $Y_{11}$, and the time-frequency estimated signal of the second sound source in the second MIC is $Y_{22}$. In such case, the time-frequency estimated signal of the second sound source in the first MIC is obtained to be $Y_{12}=X_1-Y_{11}$ by calculations. The mask value of the first sound source in the first MIC may be $\alpha\times\log(Y_{ii}/Y_{12})$, and the mask value of the first sound source in the second MIC may be $\alpha\times\log(Y_{21}/Y_{22})$. Alternatively, $\alpha\times\log(Y_{11}/Y_{12})$ is mapped to the interval (0, 1) through the nonlinear activation function sigmoid to obtain a first mapping value as the mask value of the first sound source in the first MIC, and the first mapping value is subtracted from 1 to obtain a second mapping value as the mask value of the second sound source in the first MIC. $\alpha\times\log(Y_{21}/Y_{22})$ is mapped to the interval (0, 1) through the nonlinear activation function sigmoid to obtain a third mapping relationship as the mask value of the first sound source in the second MIC, and the third mapping relationship is subtracted from 1 to obtain a fourth mapping value as the mask value of the second sound source in the second MIC.

It should be appreciated that in another embodiment, the mask value of the sound source in the MIC may also be mapped to another predetermined interval, for example (0, 2) or (0, 3), through another nonlinear mapping function relationship. In such case, when the updated time-frequency estimated signal is subsequently calculated, division by a coefficients with corresponding multiples is required.

In the embodiment of the present disclosure, the mask value of any sound source in a MIC may be mapped to the predetermined interval by a nonlinear mapping function such as the sigmoid function, so that excessive mask value appeared in some embodiments may be dynamically reduced to simplify calculation, and a reference standard may further be unified for subsequent calculation of the updated time-frequency estimated signal to facilitate subsequent acquisition of a more accurate updated time-frequency estimated signal. In particular, if the predetermined interval is limited to be (0, 1) and only two MICs are involved in mask value calculation, a calculation process of the mask value of the other sound source in the same MIC may be greatly simplified.

Of course, in another embodiment, the mask value may also be acquired in another manner if the proportion of the time-frequency estimated signal of each sound source in the original noisy signal of the same MIC is acquired. The dynamic range of the mask value may be reduced through the logarithmic function or in a nonlinear mapping manner, etc. There are no limits made herein.

In some embodiments, there are N sound sources, N being a natural number more than or equal to 2.

The operation that the respective time-frequency estimated signals of the at least two sound sources are updated based on the respective original noisy signals of the at least two MICs and the mask values includes the following actions.

An xth numerical value is determined based on the mask value of the Nth sound source in the xth MIC and the original noisy signal of the xth MIC, x being a positive integer less than or equal to X and X being the total number of the MICs.

The updated time-frequency estimated signal of the Nth sound source is determined based on a first numerical value to an Xth numerical value.

In an example, the first numerical value is determined based on the mask value of the Nth sound source in the first MIC and the original noisy signal of the first MIC.

The second numerical value is determined based on the mask value of the Nth sound source in the second MIC and the original noisy signal of the second MIC.

The third numerical value is determined based on the mask value of the Nth sound source in the third MIC and the original noisy signal of the third MIC.

The rest numerical values are determined in the same manner.

The Xth numerical value is determined based on the mask value of the Nth sound source in the Xth MIC and the original noisy signal of the Xth MIC.

The updated time-frequency estimated signal of the Nth sound source is determined based on the first numerical value, the second numerical value to the Xth numerical value.

Then, the updated time-frequency estimated signal of the other sound source is determined in a manner similar to the manner of determining the updated time-frequency estimated signal of the Nth sound source.

For further explaining the example, the updated time-frequency estimated signal of the Nth sound source may be calculated through the following calculation formula: $Y_N(k,n)=X_1(k,n)gmask1N+X_2(k,n)gmask2N+X_3(k,n)gmask3N+L+X_X(k,n)gmaaskXN$ where $Y_N(k,n)$ is the updated time-frequency estimated signal of the Nth sound source, k is the frequency point and n is the audio frame; $X_1(k,n)$, $X_2(k,n)$, $X_3(k,n)$, . . . and $X_X(k,n)$ are the original noisy signals of the first MIC, the second MIC, the third MIC, . . . and the Xth MIC respectively; and mask1N, mask2N, mask3N, . . . and maskXN are the mask values of the Nth sound source in the first MIC, the second MIC, the third MIC, . . . and the Xth MIC respectively.

In the embodiment of the present disclosure, the audio signals of the sounds emitted from different sound sources may be separated again based on the mask values and the original noisy signals. Since the mask value is determined based on the time-frequency estimated signal obtained by first separation of the audio signal and the ratio of the time-frequency estimated signal in the original noisy signal, band signals that are not separated by first separation may be separated and recovered to the corresponding audio signals of the respective sound sources. In such a manner, the voice damage degree of the audio signal may be reduced, so that voice enhancement may be implemented, and the quality of the audio signal from the sound source may be improved.

In some embodiments, the operation that the audio signals emitted from the at least two sound sources respectively are determined based on the respective updated time-frequency estimated signals of the at least two sound sources includes the following action.

Time-domain transform is performed on the respective updated time-frequency estimated signals of the at least two sound sources to obtain the audio signals emitted from the at least two sound sources respectively.

Herein, time-domain transform may be performed on the updated frequency-domain estimated signal based on Inverse Fast Fourier Transform (IFFT). The updated frequency-domain estimated signal may also be converted into a time-domain signal based on Inverse Short-Time Fourier Transform (ISTFT). Time-domain transform may also be performed on the updated frequency-domain signal based on other inverse Fourier transform.

Figure 2:
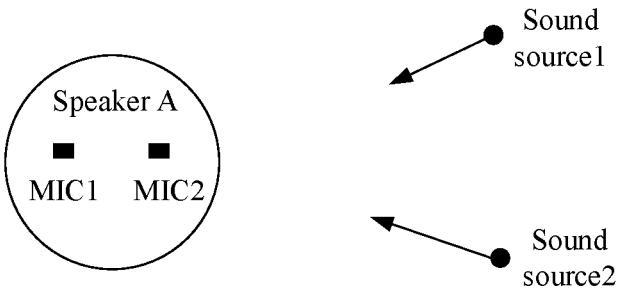
FIG. 2 is a block diagram of an application scenario of a method for processing audio signal, according to some embodiments of the disclosure.

For helping the abovementioned embodiments of the present disclosure to be understood, descriptions are made herein with the following example. As shown in FIG. 2, an application scenario of the method for processing audio signal is disclosed. A terminal includes a speaker A, the speaker A includes two MICs, i.e., a first MIC and a second MIC respectively, and there are two sound sources, i.e., a first sound source and a second sound source respectively. Signals emitted from the first sound source and the second sound source may be acquired by both the first MIC and the second MIC. The signals from the two sound sources are aliased in each MIC.

Figure 3:
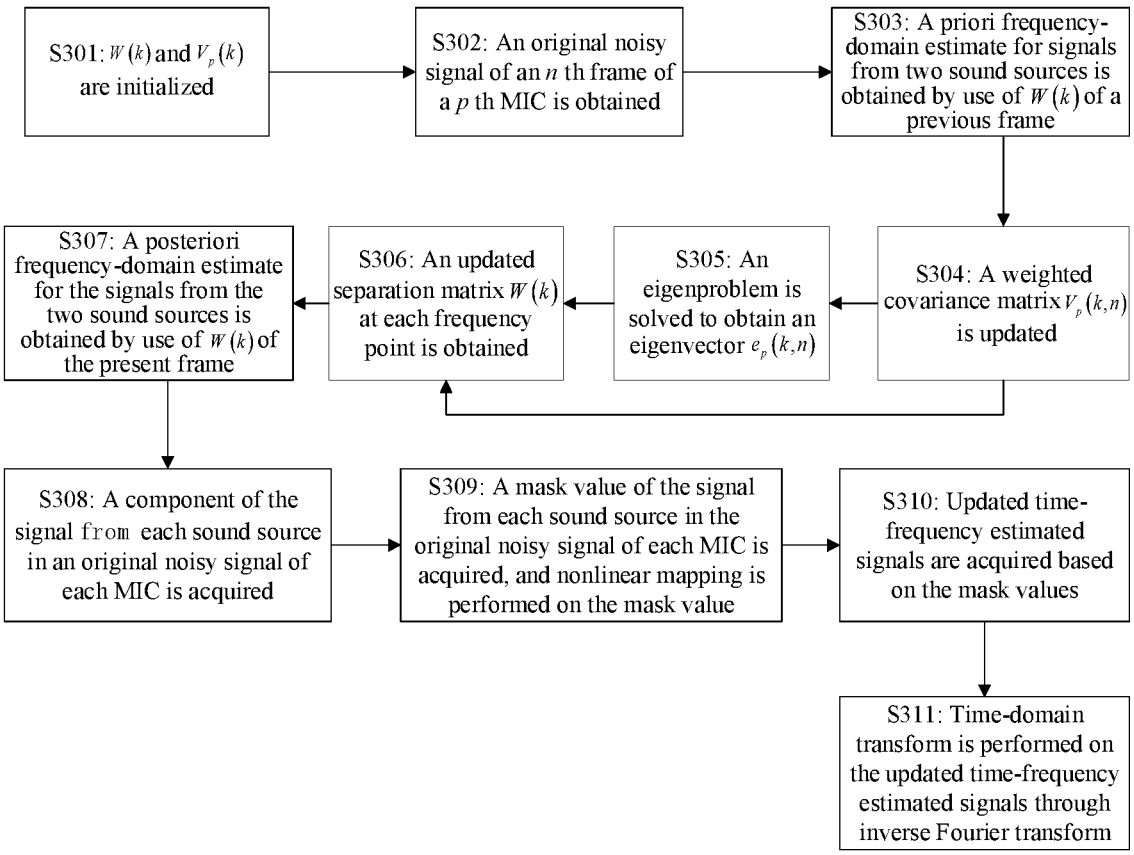
FIG. 3 is a flow chart showing a method for processing audio signal, according to some embodiments of the disclosure.

FIG. 3 is a flow chart showing a method for processing audio signal, according to some embodiments of the disclosure. In the method for processing audio signal, as shown in FIG. 2, sound sources include a first sound source and a second sound source, and MICs include a first MIC and a second MIC. Based on the method for processing audio signal, audio signals from the first and second sound sources are recovered from original noisy signals of the first MIC and the second MIC. As shown in FIG. 3, the method includes the following steps.

If a frame length of a system is Nfft, a frequency point is K=Nfft/2+1.

In S301, W (k) and $V_p(k)$ are initialized.

Initialization includes the following steps.

1) A separation matrix for each frequency point is initialized.

$$W(k) = [w_1(k), w_2(k)]^H = \begin{bmatrix} 1 & 0 \\ 0 & 1 \end{bmatrix}, \text{ where } \begin{bmatrix} 1 & 0 \\ 0 & 1 \end{bmatrix}$$

is an identity matrix, k is the frequency point, and k=1,L, K.

2) A weighted covariance matrix $V_p(k)$ of each sound source at each frequency point is initialized.

$$V_p(k) = \begin{bmatrix} 0 & 0 \\ 0 & 0 \end{bmatrix}, \text{ where } \begin{bmatrix} 0 & 0 \\ 0 & 0 \end{bmatrix}$$

is a zero matrix, p is used to represent the MIC, and p=1,2.

In S302, an original noisy signal of the n th frame of the p th MIC is obtained.

$x_p^n(m)$ is windowed to perform STFT based on Nfft points to obtain a corresponding frequency-domain signal: $X_p(k, n)=STFT(x_p^n(m))$, where m is the number of points selected for Fourier transform, STFT is short-time Fourier transform, and $x_p^n(m)$ is a time-domain signal the n th frame of the p th MIC. Herein, the time-domain signal is the original noisy signal.

Then, an observed signal of $X_p(k,n)$ is $X(k,n)=[X_1(k,n), X_2(k,n)]^T$, where $[X_1(k,n), X_2(k,n)]^T$ is a transposed matrix.

In S303, a priori frequency-domain estimate for the signals from the two sound sources is obtained by use of W (k) of a previous frame.

It is set that the priori frequency-domain estimate for the signals from the two sound sources is $Y(k,n)=[Y_1(k,n), Y_2(k,n)]^T$, where $Y_1(k,n)$, $Y_2(k,n)$ are estimated values for the first sound source and the second sound source at a frequency-frequency point (k,n) respectively.

A observation matrix X (k,n) is separated through the separation matrix W (k) to obtain that Y (k,n)=W'(k) X (k,n), where W (k) is a separation matrix for the previous frame (i.e., a previous frame of a present frame).

Then, a priori frequency-domain estimate for the n th frame of the signal from the p th sound source is: $\overline{Y}_p(n)=[Y_p(1, n), L\ Y_p(K,n)]^T$.

In S304, a weighted covariance matrix $V_p(k,n)$ is updated.

The updated weighted covariance matrix is calculated to be: $V_p(k,n)=\beta V_p(k, n-1)+(1-\beta)\varphi_p(k,n)\ X_p(k,n)\ X_p^H(k,n)$, where β is a smoothing coefficient, β being 0.98 in an embodiment; $V_p(k, n-1)$ is a weighted covariance matrix of the previous frame; $X_p^H(k,n)$ is a conjugate transpose matrix of $X_p(k,n)$;

$$\varphi_p(n) = \frac{G'(\overline{Y}_p(n))}{r_p(n)}$$

is a weighting coefficient, $$r_p(n) = \sqrt{\sum_{k=1}^{K} |Y_p(k, n)|^2}$$

being an auxiliary variable; and $G(\overline{Y}_p(n))=-\log p(\overline{Y}_p(n))$ is a contrast function.

$p(\overline{Y}_p(n))$ represents a whole-band-based multidimensional super-Gaussian priori probability density function of the p th sound source. In an embodiment, $$p(\overline{Y}_p(n)) = \exp\left(-\sqrt{\sum_{k=1}^{K} |Y_p(k, n)|^2}\right).$$

In such case, if $$G(\overline{Y}_p(n)) = -\log p(\overline{Y}_p(n)) = \sqrt{\sum_{k=1}^{K} |Y_p(k,n)|^2} = r_p(n),$$

$$\varphi_p(n) = \frac{1}{\sqrt{\sum_{k=1}^{K} |Y_p(k,n)|^2}}.$$

In S305, an eigenproblem is solved to obtain an eigenvector $e_p(k,n)$.

Herein, $e_p(k,n)$ is an eigenvector corresponding to the p th MIC.

The eigenproblem $V_2(k,n)\, e_p(k,n)=\lambda_p(k,n)V_1(k,n)\, e_p(k,n)$ is solved to obtain:

$$\lambda_1(k,n) = \frac{tr(H(k,n)) + \sqrt{tr(H(k,n))^2 - 4\,det(H(k,n))}}{2},$$

$$e_1(k,n) = \begin{pmatrix} H_{22}(k,n) - \lambda_1(k,n) \\ -H_{21}(k,n) \end{pmatrix},$$

$$\lambda_2(k,n) = \frac{tr(H(k,n)) - \sqrt{tr(H(k,n))^2 - 4\,det(H(k,n))}}{2} \text{ and}$$

$$e_2(k,n) = \begin{pmatrix} -H_{12}(k,n) \\ H_{11}(k,n) - \lambda_2(k,n) \end{pmatrix},$$

$$\text{where } H(k,n) = V_1^{-1}(k,n)V_2(k,n).$$

In S306, an updated separation matrix W (k) for each frequency point is obtained.

The updated separation matrix for the present frame is obtained to be $$w_p(k) = \frac{e_p(k,n)}{e_p^H(k,n)V_P(k,n)e_p(k,n)}$$

based on the eigenvector of the eigenproblem.

In S307, a posteriori frequency-domain estimate for the signals from the two sound sources is obtained by use of W (k) of the present frame.

The original noisy signal is separated by use of W (k) of the present frame to obtain the posteriori frequency-domain estimate $Y(k,n)=[Y_1(k,n), Y_2(k,n)]^T=W(k)X(k,n)$ for the signals from the two sound sources.

It can be understood that calculation in subsequent steps may be implemented by use of the priori frequency-domain estimate or the posteriori frequency-domain estimate. Using the priori frequency-domain estimate may simplify a calculation process, and using the posteriori frequency-domain estimate may obtain a more accurate audio signal of each sound source. Herein, the process of S301 to S307 may be considered as first separation for the signals from the sound sources, and the priori frequency-domain estimate or the posteriori frequency-domain estimate may be considered as the time-frequency estimated signal in the abovementioned embodiment.

It can be understood that, in the embodiment of the present disclosure, for further reducing voice damages, the separated audio signal may be re-separated based on a mask value to obtain a re-separated audio signal.

In S308, a component of the signal from each sound source in an original noisy signal of each MIC is acquired.

Through the step, the component $Y_1(k,n)$ of the first sound source in the original noisy signal $X_1(k,n)$ of the first MIC may be obtained.

The component $Y_2(k,n)$ of the second sound source in the original noisy signal $X_2(k,n)$ of the second MIC may be obtained.

Then, the component of the second sound source in the original noisy signal $X_1(k,n)$ of the first MIC is $Y_2'(k,n)=X_1(k,n)-Y_1(k,n)$.

The component of the first sound source in the original noisy signal $X_2(k,n)$ of the second MIC is $Y_1'(k,n)=X_2(k,n)-Y_2(k,n)$.

In S309, a mask value of the signal from each sound source in the original noisy signal of each MIC is acquired, and nonlinear mapping is performed on the mask value.

The mask value of the first sound source in the original noisy signal of the first MIC is obtained to be mask11(k,n)=20*log 10(abs ($Y_1$(k,n))/abs($Y_2'$(k,n))).

Nonlinear mapping is performed on the mask value of the first sound source in the original noisy signal of the first MIC as follows: mask11(k,n)=sigmoid (mask11(k,n),0,0.1).

Then the mask value of the second sound source in the first MIC is mask12(k,n)=1−mask11(k,n).

The mask value of the first sound source in the original noisy signal of the second MIC is obtained to be mask21 (k,n)=20*log 10(abs (k,n))/abs ($Y_2$(k,n))).

Nonlinear mapping is performed on the mask value of the first sound source in the original noisy signal of the second MIC as follows: mask21(k,n)=sigmoid (mask21(k,n),0,0.1).

Then the mask value of the second sound source in the original noisy signal of the second MIC is mask22(k,n)=1−mask21(k,n).

Herein, $$sigmoid(x,a,c) = \frac{1}{1+e^{-a(x-c)}}.$$

In the embodiment, a=0 and c is 0.1. Herein, x is the mask value, a is a coefficient representing a degree of curvature of a function curve of the sigmoid function, and c is a coefficient representing translation of the function curve of the sigmoid function on the axis x.

In S310, updated time-frequency estimated signals are acquired based on the mask values.

The updated time-frequency estimated signal of each sound source may be acquired based on the mask value of the sound source in each MIC and the original noisy signal of each MIC:

$Y_1(k,n)=(X_1(k,n)*mask11+X_2(k,n)*mask21)/2$, where $Y_1(k,n)$ is the updated time-frequency estimated signal of the first sound source; and $Y_2(k,n)=(X_1(k,n)*mask12+X_2(k,n)*mask22)/2$, where $Y_2(k,n)$ is the updated time-frequency estimated signal of the second sound source.

In S311, time-domain transform is performed on the updated time-frequency estimated signals through inverse Fourier transform.

ISTFT and overlapping-addition are performed on) $\overline{Y}_p(n)=[Y_p(1,n), \ldots Y_p(K,n)]^T$ to obtain an estimated time-domain audio signal $s_p''(m)$=ISTFT ($\overline{Y}_p(n)$) respectively.

In the embodiment of the present disclosure, the original noisy signals of the two MICs are separated to obtain the time-frequency estimated signals of sounds emitted from the two sound sources in each MIC respectively, so that the time-frequency estimated signals of the sounds emitted from the two sound sources in each MIC may be preliminarily separated from the original noisy signals. Furthermore, the mask values of the two sound sources in the two MICs respectively may further be obtained based on the time-frequency estimated signals, and the updated time-frequency estimated signals of the sounds emitted from the two sound sources are acquired based on the original noisy signals and the mask values. Therefore, according to the embodiment of the present disclosure, the sounds emitted from the two sound sources may further be separated according to the original noisy signals and the preliminarily separated time-frequency estimated signals. In addition, the mask values is a proportion of the time-frequency estimated signal of a sound source in the original noisy signal of a MIC, so that part of bands that are not separated by preliminary separation may be recovered into the audio signals of their corresponding sound sources, voice damage degrees of the separated audio signals may be reduced, and the separated audio signal of each sound source is higher in quality.

Moreover, only two MICs are used, compared with the conventional art that a beamforming technology based on three or more MICs is adopted to implement sound source separation, the embodiment of the present disclosure has the advantages that, on one hand, the number of the MICs is greatly reduced, which reduces hardware cost of a terminal; and on the other hand, positions of multiple MICs are not required to be considered, which may implement more accurate separation of the audio signals emitted from different sound sources.

Figure 4:
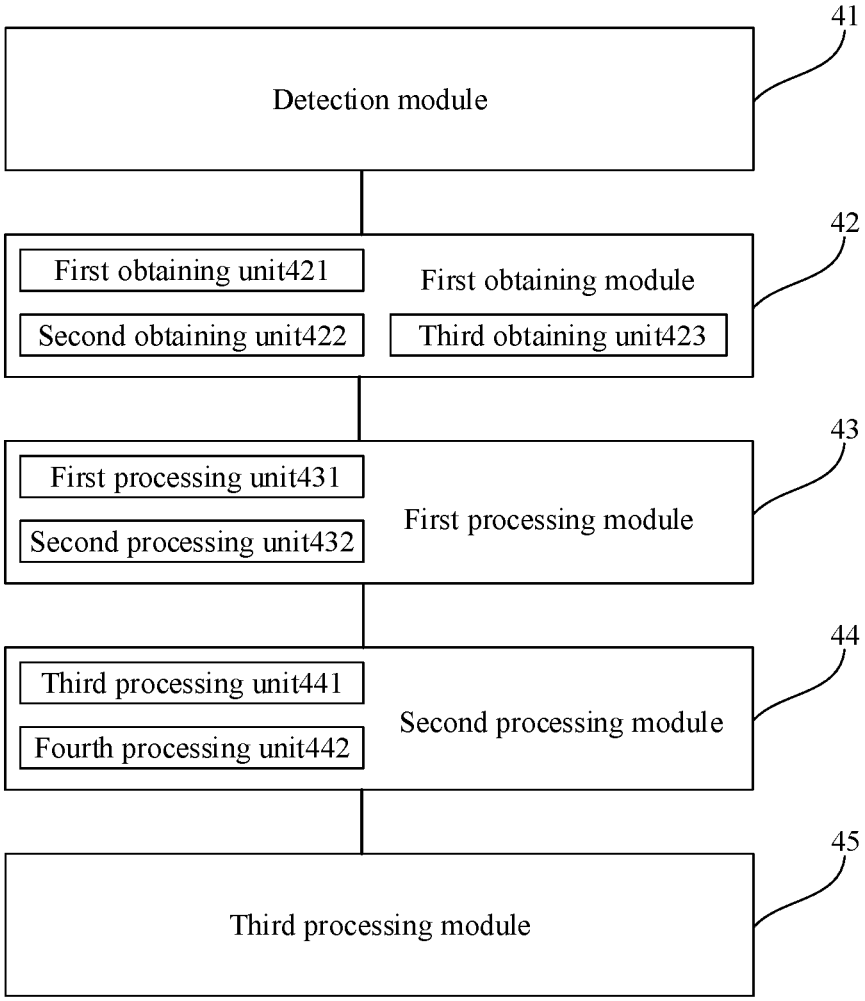
FIG. 4 is a schematic diagram illustrating a device for processing audio signal, according to some embodiments of the disclosure.

FIG. 4 is a block diagram of a device for processing audio signal, according to some embodiments of the disclosure. Referring to FIG. 4, the device includes a detection module 41, a first obtaining module 42, a first processing module 43, a second processing module 44 and a third processing module 45.

The detection module 41 is configured to acquire audio signals emitted from at least two sound sources respectively through at least two MICs to obtain respective original noisy signals of the at least two MICs.

The first obtaining module 42 is configured to perform sound source separation on the respective original noisy signals of the at least two MICs to obtain respective time-frequency estimated signals of the at least two sound sources.

The first processing module 43 is configured to determine a mask value of the time-frequency estimated signal of each sound source in the original noisy signal of each MIC based on the respective time-frequency estimated signals of the at least two sound sources.

The second processing module 44 is configured to update the respective time-frequency estimated signals of the at least two sound sources based on the respective original noisy signals of the at least two MICs and the mask values.

The third processing module 45 is configured to determine the audio signals emitted from the at least two sound sources respectively based on the respective updated time-frequency estimated signals of the at least two sound sources.

In some embodiments, the first obtaining module 42 includes a first obtaining unit 421 and a second obtaining unit 422.

The first obtaining unit 421 is configured to acquire a first separated signal of a present frame based on a separation matrix and the present frame of the original noisy signal. The separation matrix is a separation matrix for the present frame or a separation matrix for a previous frame of the present frame.

A second obtaining unit 422 is configured to combine the first separated signal of each frame to obtain the time-frequency estimated signal of each sound source.

In some embodiments, when the present frame is a first frame, the separation matrix for the first frame is an identity matrix.

The first obtaining unit 421 is configured to acquire the first separated signal of the first frame based on the identity matrix and the original noisy signal of the first frame.

In some embodiments, the first obtaining module 41 further includes a third obtaining unit 423.

The third obtaining unit 423 is configured to, when the present frame is an audio frame after the first frame, determine the separation matrix for the present frame based on the separation matrix for the previous frame of the present frame and the original noisy signal of the present frame.

In some embodiments, the first processing module 43 includes a first processing unit 431 and a second processing unit 432.

The first processing unit 431 is configured to obtain a proportion value based on the time-frequency estimated signal of any of the sound sources in each MIC and the original noisy signal of the MIC.

The second processing unit 432 is configured to perform nonlinear mapping on the proportion value to obtain the mask value of the sound source in each MIC.

In some embodiments, the second processing unit 432 is configured to perform nonlinear mapping on the proportion value by use of a monotonic increasing function to obtain the mask value of the sound source in each MIC.

In some embodiments, there are N sound sources, N being a natural number more than or equal to 2, and the second processing module 44 includes a third processing unit 441 and a fourth processing unit 442.

The third processing unit 441 is configured to determine an xth numerical value based on the mask value of the Nth sound source in the xth MIC and the original noisy signal of the xth MIC, x being a positive integer less than or equal to X and X being the total number of the MICs.

The fourth processing unit 442 is configured to determine the updated time-frequency estimated signal of the Nth sound source based on a first numerical value to an Xth numerical value.

With respect to the device in the above embodiment, the specific manners for performing operations for individual modules therein have been described in detail in the embodiment regarding the method, which will not be elaborated herein.

The embodiments of the present disclosure also provide a terminal, which includes:

a processor; and a memory for storing instructions executable by the processor, wherein the processor is configured to execute the executable instructions to implement the method for processing audio signal in any embodiment of the present disclosure.

The memory may include any type of storage medium, and the storage medium is a non-transitory computer storage medium and may keep information stored thereon when a communication device is powered off.

The processor may be connected with the memory through a bus and the like, and is configured to read an executable program stored in the memory to implement, for example, at least one of the methods shown in FIG. 1 and FIG. 3.

The embodiments of the present disclosure further provide a computer-readable storage medium having stored therein an executable program, the executable program being executed by a processor to implement the method for processing audio signal in any embodiment of the present disclosure, for example, for implementing at least one of the methods shown in FIG. 1 and FIG. 3.

With respect to the device in the above embodiment, the specific manners for performing operations for individual modules therein have been described in detail in the embodiment regarding the method, which will not be elaborated herein.

The technical solutions provided by the embodiments of the present disclosure may have the following beneficial effects.

In the embodiments of the present disclosure, the original noisy signals of the at least two MICs are separated to obtain the respective time-frequency estimated signals of sounds emitted from the at least two sound sources in each MIC, so that preliminary separation may be implemented by use of dependence between signals from different sound sources to separate the sounds emitted from the at least two sound sources in the original noisy signal. Therefore, compared with separating signals from different sound sources by use of a multi-MIC beamforming technology in the related art, this manner has the advantage that positions of these MICs are not required to be considered, so that the audio signals of the sounds emitted from different sound sources may be separated more accurately.

In addition, in the embodiments of the present disclosure, the mask values of the at least two sound sources in each MIC may also be obtained based on the time-frequency estimated signals, and the updated time-frequency estimated signals of the sounds emitted from the at least two sound sources are acquired based on the respective original noisy signals of the MICs and the mask values. Therefore, in the embodiments of the present disclosure, the sounds emitted from the at least two sound sources may further be separated according to the original noisy signals and the preliminarily separated time-frequency estimated signals. Moreover, the mask value is a proportion of the time-frequency estimated signal of each sound source in the original noisy signal of each MIC, so that part of bands that are not separated by preliminary separation may be recovered into the audio signals of the corresponding sound sources, voice damage degree of the audio signal after separation may be reduced, and the separated audio signal of each sound source is higher in quality.

Figure 5:
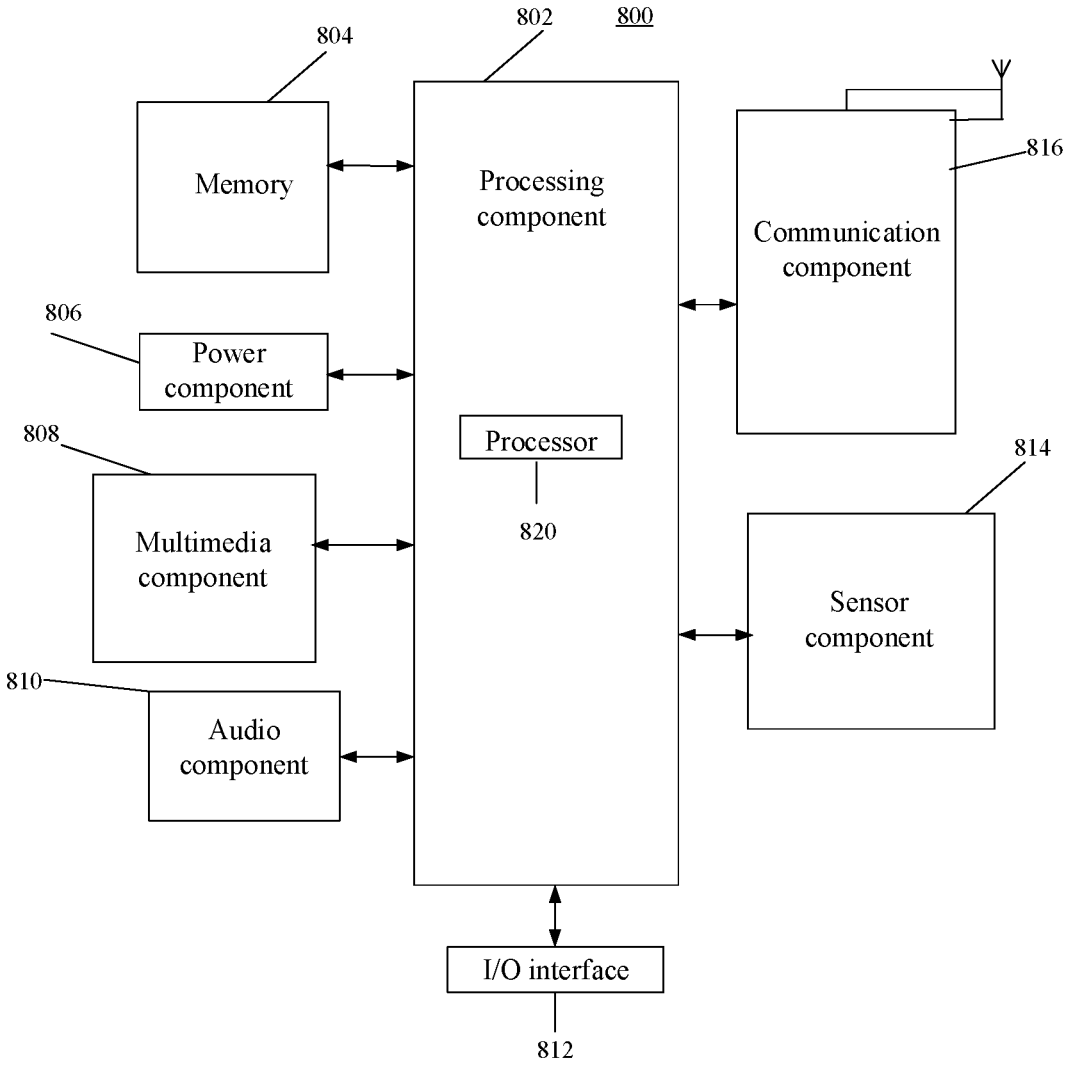
FIG. 5 is a block diagram of a terminal, according to some embodiments of the disclosure.

FIG. 5 is a block diagram of a terminal 800, according to some embodiments of the disclosure. For example, the terminal 800 may be a mobile phone, a computer, a digital broadcast terminal, a messaging device, a gaming console, a tablet, a medical device, exercise equipment, a personal digital assistant and the like.

Referring to FIG. 5, the terminal 800 may include one or more of the following components: a processing component 802, a memory 804, a power component 806, a multimedia component 808, an audio component 810, an Input/Output (I/O) interface 812, a sensor component 814, and a communication component 816.

The processing component 802 typically controls overall operations of the terminal 800, such as the operations associated with display, telephone calls, data communications, camera operations, and recording operations. The processing component 802 may include one or more processors 820 to execute instructions to perform all or part of the steps in the abovementioned method. Moreover, the processing component 802 may include one or more modules which facilitate interaction between the processing component 802 and the other components. For instance, the processing component 802 may include a multimedia module to facilitate interaction between the multimedia component 808 and the processing component 802.

The memory 804 is configured to store various types of data to support the operation of the device 800. Examples of such data include instructions for any application programs or methods operated on the terminal 800, contact data, phonebook data, messages, pictures, video, etc. The memory 804 may be implemented by any type of volatile or non-volatile memory devices, or a combination thereof, such as an Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, a magnetic or an optical disk.

The power component 806 provides power for various components of the terminal 800. The power component 806 may include a power management system, one or more power supplies, and other components associated with generation, management and distribution of power for the terminal 800.

The multimedia component 808 includes a screen providing an output interface between the terminal 800 and a user. In some embodiments, the screen may include a Liquid Crystal Display (LCD) and a Touch Panel (TP). If the screen includes the TP, the screen may be implemented as a touch screen to receive an input signal from the user. The TP includes one or more touch sensors to sense touches, swipes and gestures on the TP. The touch sensors may not only sense a boundary of a touch or swipe action but also detect a duration and pressure associated with the touch or swipe action. In some embodiments, the multimedia component 808 includes a front camera and/or a rear camera. The front camera and/or the rear camera may receive external multimedia data when the device 800 is in an operation mode, such as a photographing mode or a video mode. Each of the front camera and the rear camera may be a fixed optical lens system or have focusing and optical zooming capabilities.

The audio component 810 is configured to output and/or input an audio signal. For example, the audio component 810 includes a MIC, and the MIC is configured to receive an external audio signal when the terminal 800 is in the operation mode, such as a call mode, a recording mode and a voice recognition mode. The received audio signal may further be stored in the memory 804 or sent through the communication component 816. In some embodiments, the audio component 810 further includes a speaker configured to output the audio signal.

The I/O interface 812 provides an interface between the processing component 802 and a peripheral interface module, and the peripheral interface module may be a keyboard, a click wheel, a button and the like. The button may include, but not limited to: a home button, a volume button, a starting button and a locking button.

The sensor component 814 includes one or more sensors configured to provide status assessment in various aspects for the terminal 800. For instance, the sensor component 814 may detect an on/off status of the device 800 and relative positioning of components, such as a display and small keyboard of the terminal 800. The sensor component 814 may further detect a change in a position of the terminal 800 or a component of the terminal 800, presence or absence of contact between the user and the terminal 800, orientation or acceleration/deceleration of the terminal 800 and a change in temperature of the terminal 800. The sensor component 814 may include a proximity sensor configured to detect presence of an object nearby without any physical contact. The sensor component 814 may also include a light sensor, such as a Complementary Metal Oxide Semiconductor (CMOS) or Charge Coupled Device (CCD) image sensor, configured for use in an imaging application. In some embodiments, the sensor component 814 may also include an acceleration sensor, a gyroscope sensor, a magnetic sensor, a pressure sensor or a temperature sensor.

The communication component 816 is configured to facilitate wired or wireless communication between the terminal 800 and another device. The terminal 800 may access a communication-standard-based wireless network, such as a Wireless Fidelity (WiFi) network, a 2nd-Generation (2G) or 3rd-Generation (3G) network or a combination thereof. In some embodiments of the disclosure, the communication component 816 receives a broadcast signal or broadcast associated information from an external broadcast management system through a broadcast channel. In some embodiments of the disclosure, the communication component 816 further includes a Near Field Communication (NFC) module to facilitate short-range communication. For example, the NFC module may be implemented based on a Radio Frequency Identification (RFID) technology, an Infrared Data Association (IrDA) technology, an Ultra-Wide Band (UWB) technology, a Bluetooth (BT) technology and another technology.

In some embodiments of the disclosure, the terminal 800 may be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors or other electronic components, and is configured to execute the abovementioned method.

In some embodiments of the disclosure, there is also provided a non-transitory computer-readable storage medium including instructions, such as the memory 804 including instructions, and the instructions may be executed by the processor 820 of the terminal 800 to implement the abovementioned method. For example, the non-transitory computer-readable storage medium may be a ROM, a Random Access Memory (RAM), a Compact Disc Read-Only Memory (CD-ROM), a magnetic tape, a floppy disc, an optical data storage device and the like.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In some embodiments, the control and/or interface software or app can be provided in a form of a non-transitory computer-readable storage medium having instructions stored thereon is further provided. For example, the non-transitory computer-readable storage medium can be a ROM, a CD-ROM, a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a standalone program or as a portion, component, subroutine, object, or other portion suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

What is claimed is:

1. A method for processing audio signals, comprising:

obtaining, by at least two microphones of a terminal, respective original noisy signals of the at least two microphones based on at least two audio signals emitted respectively from at least two sound sources;

performing, by the terminal, a sound source separation on the respective original noisy signals of the at least two microphones to obtain respective time-frequency estimated signals of the at least two sound sources;

obtaining, by the terminal, a proportion value based on the time-frequency estimated signal of each of the at least two sound sources and the original noisy signal of each of the at least two microphones;

performing, by the terminal, nonlinear mapping on the proportion value to obtain a mask value of each of the at least two sound sources in each of the at least two microphones;

updating, by the terminal, the respective time-frequency estimated signals of the at least two sound sources based on the respective original noisy signals of the at least two microphones and mask values; and determining, by the terminal, the at least two audio signals emitted respectively from the at least two sound sources based on the respective updated time-frequency estimated signals of the at least two sound sources.

2. The method of claim 1, wherein performing, by the terminal, the sound source separation on the respective original noisy signals of the at least two microphones to obtain the respective time-frequency estimated signals of the at least two sound sources comprises:

acquiring, by the terminal, a first separated signal of a present frame based on a separation matrix and an original noisy signal of the present frame, wherein the separation matrix is a separation matrix for the present frame or a separation matrix for a previous frame of the present frame; and combining, by the terminal, the first separated signal of each frame to obtain the time-frequency estimated signal of each of the at least two sound sources.

3. The method of claim 2, wherein when the present frame is a first frame, the separation matrix for the first frame is an identity matrix; and acquiring, by the terminal, the first separated signal of the present frame based on the separation matrix and the original noisy signal of the present frame comprises:

acquiring, by the terminal, the first separated signal of the first frame based on the identity matrix and the original noisy signal of the first frame.

4. The method of claim 2, further comprising:

when the present frame is an audio frame after a first frame, determining, by the terminal, the separation matrix for the present frame based on the separation matrix for the previous frame of the present frame and the original noisy signal of the present frame.

5. The method of claim 1, wherein performing, by the terminal, the nonlinear mapping on the proportion value to obtain the mask value of each of the at least two sound sources in each of the at least two microphones comprises:

performing, by the terminal, the nonlinear mapping on the proportion value by using a monotonic increasing function to obtain the mask value.

6. The method of claim 1, wherein when the number of the at least two sound sources is N and N is a natural number more than or equal to 2, updating, by the terminal, the respective time-frequency estimated signals of the at least two sound sources based on the respective original noisy signals of the at least two microphones and the mask values comprises:

determining, by the terminal, an xth numerical value based on the mask value of the Nth sound source in the xth microphone and the original noisy signal of the xth microphone, wherein x is a positive integer less than or equal to X and X is the total number of the at least two microphones; and determining, by the terminal, the updated time-frequency estimated signal of the Nth sound source based on numerical values from a first numerical value to an Xth numerical value.

7. A device for processing audio signals, comprising:

a processor; and a memory for storing a set of instructions executable by the processor;

wherein the processor is configured to execute the instructions to:

obtain respective original noisy signals of at least two microphones based on at least two audio signals emitted respectively from at least two sound sources through the at least two microphones;

perform a sound source separation on the respective original noisy signals of the at least two microphones to obtain respective time-frequency estimated signals of the at least two sound sources;

obtain a proportion value based on the time-frequency estimated signal of each of the at least two sound sources and the original noisy signal of each of the at least two microphones;

perform nonlinear mapping on the proportion value to obtain a mask value of each of the at least two sound sources in each of the at least two microphones;

update the respective time-frequency estimated signals of the at least two sound sources based on the respective original noisy signals of the at least two microphones and mask values; and determine the at least two audio signals emitted respectively from the at least two sound sources based on the respective updated time-frequency estimated signals of the at least two sound sources.

8. The device of claim 7, wherein the processor is further configured to:

acquire a first separated signal of a present frame based on a separation matrix and an original noisy signal of the present frame, wherein the separation matrix is a separation matrix for the present frame or a separation matrix for a previous frame of the present frame; and combine the first separated signal of each frame to obtain the time-frequency estimated signal of each of the at least two sound sources.

9. The device of claim 8, wherein when the present frame is a first frame, the separation matrix for the first frame is an identity matrix; and the processor is further configured to acquire the first separated signal of the first frame based on the identity matrix and the original noisy signal of the first frame.

10. The device of claim 8, wherein the processor is further configured to:

when the present frame is an audio frame after a first frame, determine the separation matrix for the present frame based on the separation matrix for the previous frame of the present frame and the original noisy signal of the present frame.

11. The device of claim 7, wherein the processor is configured to perform the nonlinear mapping on the proportion value by using a monotonic increasing function to obtain the mask value.

12. The device of claim 7, wherein when the number of the at least two sound sources is N and N is a natural number more than or equal to 2, the processor is further configured to:

determine an xth numerical value based on the mask value of the Nth sound source in the xth microphone and the original noisy signal of the xth microphone, wherein x is a positive integer less than or equal to X and X is the total number of the microphones; and determine the updated time-frequency estimated signal of the Nth sound source based on numerical values from a first numerical value to an Xth numerical value.

13. A non-transitory computer-readable storage medium storing a plurality of programs for execution by a terminal having one or more processors, wherein the plurality of programs, when executed by the one or more processors, cause the terminal to perform acts comprising:

obtaining respective original noisy signals of at least two microphones based on at least two audio signals emitted respectively from at least two sound sources through the at least two microphones;

performing a sound source separation on the respective original noisy signals of the at least two microphones to obtain respective time-frequency estimated signals of the at least two sound sources;

obtaining a proportion value based on the time-frequency estimated signal of each of the at least two sound sources and the original noisy signal of each of the at least two microphones;

performing nonlinear mapping on the proportion value to obtain a mask value of each of the at least two sound sources in each of the at least two microphones;

updating the respective time-frequency estimated signals of the at least two sound sources based on the respective original noisy signals of the at least two microphones and mask values; and determining the at least two audio signals emitted respectively from the at least two sound sources based on the respective updated time-frequency estimated signals of the at least two sound sources.

14. The non-transitory computer-readable storage medium of claim 13, wherein performing the sound source separation on the respective original noisy signals of the at least two microphones to obtain the respective time-frequency estimated signals of the at least two sound sources comprises:

acquiring a first separated signal of a present frame based on a separation matrix and an original noisy signal of the present frame, wherein the separation matrix is a separation matrix for the present frame or a separation matrix for a previous frame of the present frame; and combining the first separated signal of each frame to obtain the time-frequency estimated signal of each of the at least two sound sources.

15. The non-transitory computer-readable storage medium of claim 14, wherein when the present frame is a first frame, the separation matrix for the first frame is an identity matrix; and acquiring the first separated signal of the present frame based on the separation matrix and the original noisy signal of the present frame comprises:

acquiring the first separated signal of the first frame based on the identity matrix and the original noisy signal of the first frame.

16. The non-transitory computer-readable storage medium of claim 14, wherein the method further comprises:

when the present frame is an audio frame after a first frame, determining the separation matrix for the present frame based on the separation matrix for the previous frame of the present frame and the original noisy signal of the present frame.

17. The non-transitory computer-readable storage medium of claim 13, wherein performing the nonlinear mapping on the proportion value to obtain the mask value of each of the at least two sound sources in each of the at least two microphones comprises:

performing the nonlinear mapping on the proportion value by using a monotonic increasing function to obtain the mask value.

* * * * *